US006093065A

United States Patent [19]

Chadbourne

[11] Patent Number: 6,093,065

[45] Date of Patent: Jul. 25, 2000

[54] ELECTRICAL WEDGE CONNECTOR HAVING SLEEVE WITH WEDGE LOCKING TABS

[75] Inventor: Richard Chadbourne, Merrimack, N.H.

[73] Assignee: Framatome Connectors USA, Inc., Etters, Pa.

[21] Appl. No.: 09/176,854

[22] Filed: Oct. 22, 1998

[51] Int. Cl.[7] ..... H01R 4/50; H01R 11/01

[52] U.S. Cl. ..... 439/783

[58] Field of Search ..... 439/783

[56] References Cited

U.S. PATENT DOCUMENTS

| | | | |
|---|---|---|---|
| 3,275,974 | 9/1966 | Mixon, Jr. . | |
| 4,650,273 | 3/1987 | Roosdrop . | |
| 5,044,996 | 9/1991 | Goto | 439/783 |
| 5,145,420 | 9/1992 | Counsel et al. | 439/783 |
| 5,507,671 | 4/1996 | Chadbourne et al. | 439/783 |
| 5,538,447 | 7/1996 | Chadbourne et al. | 439/783 |
| 5,558,546 | 9/1996 | Chadbourne et al. | 439/783 |
| 5,567,186 | 10/1996 | Diniz et al. | 439/783 |
| 5,613,883 | 3/1997 | Chadbourne et al. | 439/783 |
| 5,679,031 | 10/1997 | Chadbourne et al. | 439/783 |

FOREIGN PATENT DOCUMENTS

| | | |
|---|---|---|
| 0 018 800 | 12/1980 | United Kingdom . |
| WO98/27621 | 6/1998 | WIPO . |

*Primary Examiner*—Lincoln Donovan
*Assistant Examiner*—Javaid Nasri
*Attorney, Agent, or Firm*—Perman & Green, LLP

[57] ABSTRACT

An electrical wedge connector with a sleeve and a wedge. The sleeve has two locking tabs to lock the wedge in the sleeve. The locking tabs extend into a wedge receiving area of the sleeve generally toward each other and have general cantilevered shapes.

18 Claims, 2 Drawing Sheets

FIG.3B
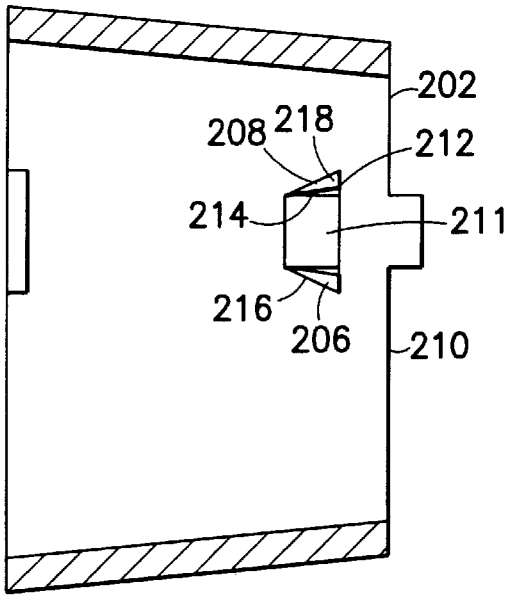
FIG.3A
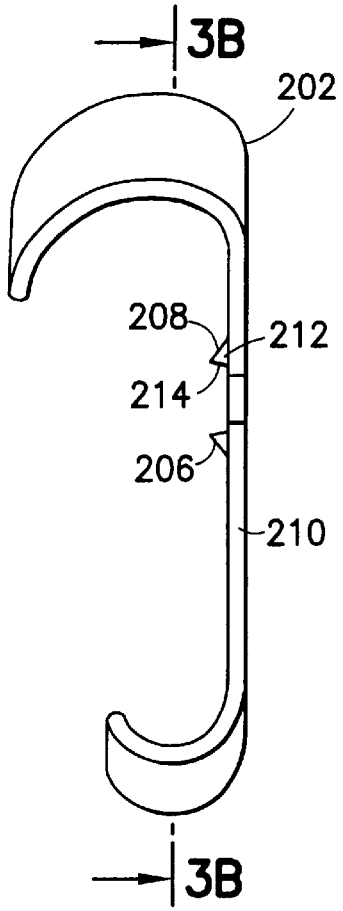
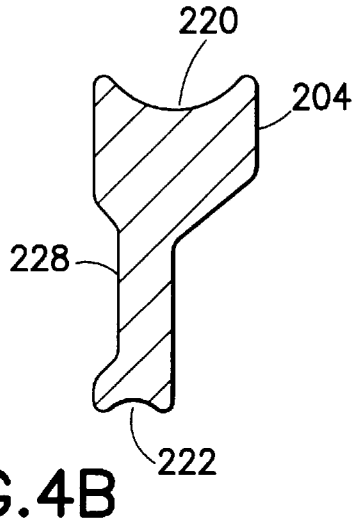
FIG.4B
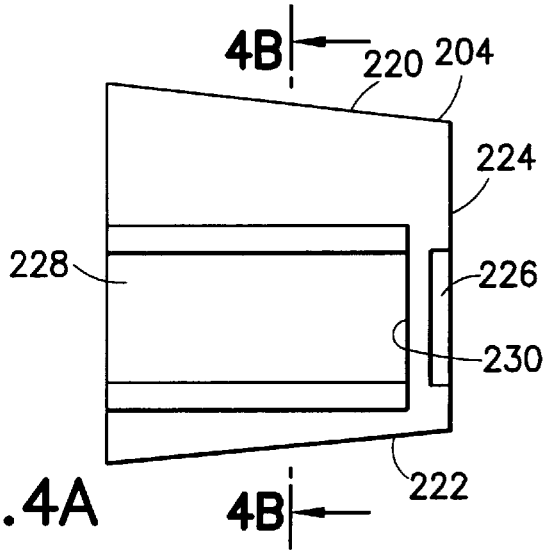
FIG.4A

ELECTRICAL WEDGE CONNECTOR HAVING SLEEVE WITH WEDGE LOCKING TABS

BACKGROUND OF THE INVENTION

1. Field of the Invention

The present invention relates to electrical connectors and, more particularly, to an electrical wedge connector.

2. Prior Art

U.S. Pat. No. 5,538,447 discloses an electrical wedge connector having a C-shaped sleeve with an inwardly projecting rear end tab. U.S. Pat. No. 5,507,671 discloses an electrical wedge connector having a C-shaped sleeve with a slot in front of a rear end tab forming a stop ledge.

SUMMARY OF THE INVENTION

In accordance with one embodiment of the present invention an electrical wedge connector is provided having a connector sleeve and a wedge insertable into the connector sleeve for wedging electrical conductors against an inside surface of the sleeve to mechanically and electrically connect the conductors to each other. The sleeve has a locking tab to lock the wedge in the sleeve. The locking tab extends in a cantilever fashion into a wedge receiving area of the sleeve. The locking tab has a front facing latching surface, a lateral open edge extending from the front facing latching surface, and a connecting section located on a side of the locking tab opposite the lateral open edge connecting the locking tab to the rest of the sleeve.

In accordance with another embodiment of the present invention an electoral wedge connector is provided having a connector sleeve and a wedge insertable into the connector sleeve for wedging electrical conductors against an inside surface of the sleeve to mechanically and electrically connect the conductors to each other. The sleeve has two locking tabs to lock the wedge in the sleeve. The locking tabs extend into a wedge receiving area of the sleeve, generally towards each other, and have general cantilevered shapes.

In accordance with one method of the present invention, a method of manufacturing a wedge connector sleeve for a wedge connector is provided comprising steps of forming a sheet metal member into a general wedge shape having a general cross sectional C-shape; and stamping the sheet metal member to form two cantilevered flaps with front facing latching surfaces formed by sheared edges occurring during the step of stamping and ramp surfaces leading up to the latching surfaces.

BRIEF DESCRIPTION OF THE DRAWINGS

The foregoing aspects and other features of the present invention are explained in the following description, taken in connection with the accompanying drawings, wherein:

FIG. 3A is a front elevational view of an alternate embodiment of the wedge connector shell;

FIG. 3B is a cross-sectional view of the shell shown in FIG. 3A taken along line 3B—3B;

FIG. 4A is a side elevational view of an alternate embodiment of the wedge connector wedge; and FIG. 4B is a cross-sectional view of the wedge shown in FIG. 4A taken along line 4B—4B.

DETAILED DESCRIPTION OF THE PREFERRED EMBODIMENT

Figure 1A:
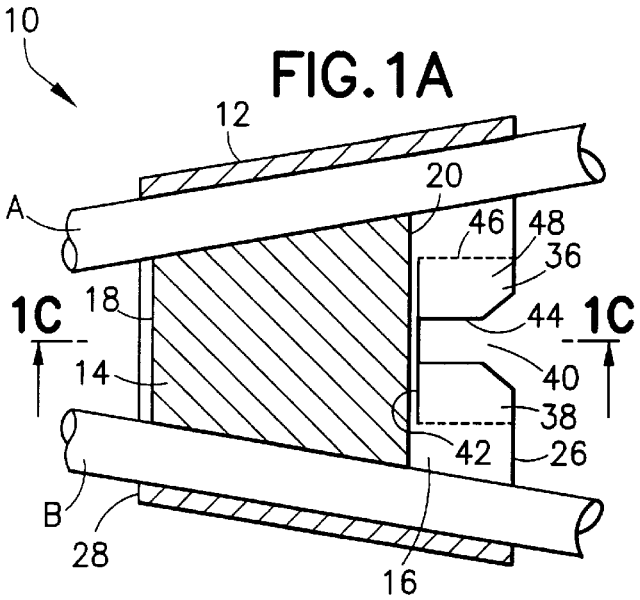
FIG. 1A is a cross-sectional view of an electrical wedge connector incorporating features of the present invention.
Figure 1B:
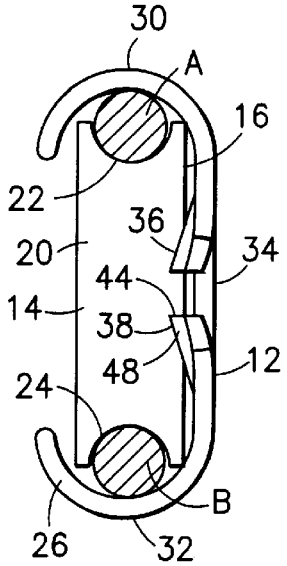
FIG. 1B is a rear end elevational view of the connector shown in FIG. 1A.
Figure 1C:
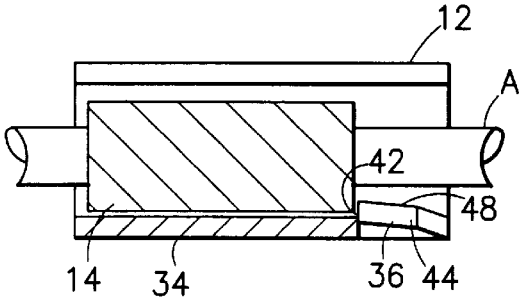
FIG. 1C is a cross-sectional view of the connector shown in FIG. 1A taken along line 1C—1C.

Referring to FIGS. 1A–1C, there is shown an electrical wedge connector 10 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

The connector 10 generally comprises a shell or sleeve 12 and a wedge 14. The wedge 14 is sized and shaped to be inserted into a receiving area 16 of the shell 12 to wedge two electrical conductors A, B between the shell 12 and the wedge 14. The wedge 14 generally comprises a solid block of material with a front end 18, a rear end 20, and two conductor contact surfaces 22, 24. In alternate embodiments other shapes, sizes, and configurations of wedges could be used. The shell 12 is preferably comprised of electrically conductive metal, such as sheet metal that is cut and formed into the general cross-sectional "C" shape which tapers from its rear end 26 to its front end 28. The shell 12 has two opposing curved areas 30, 32 with interior surfaces that form conductor contact surfaces. In this embodiment the center span 34 of the shell 12, which connects the two curved areas 30, 32 has two locking tabs or flaps 36, 38. The tabs 36, 38 are located proximate the rear end 26 of the shell 12. The tabs 36, 38 are mirror images of each other with a slot 40 therebetween. Each tab 36,38 extends in a cantilevered fashion into the wedge receiving area 16 of the shell 12. The locking tabs 36,38 each having a front facing latching surface 42, a lateral open edge 44 extending from the latching surface 42, a connecting section 46, and a ramp surface 48. The front facing latching surface 42 comprises a sheared edge along the surface 42 formed by stamping the shell 12. The lateral open edge 44 is located at the slot 40. The connecting section 46 is located on a side of the locking tab opposite the lateral open edge 44. The connecting section 46 connects the locking tab to the rest of the sleeve 12. The ramp surface 48 extends inward from the rear end of the locking tab to the front facing latching surface. In a preferred method of manufacturing the shell 12 a sheet metal member is formed into a general wedge shape having a general cross-sectional C-shape; and the sheet metal member is stamped to form the two tabs. The tabs may be formed before or after the C-shape is formed. In an alternate embodiment more or less than two locking tabs could be formed. The locking tabs need not be mirror images of each other and could be spaced longitudinally from each other along the length of the shell.

When the wedge 14 is inserted into the shell 12, the wedge 14 is inserted into the rear end 26. The ramp surfaces 48 allow the wedge 14 to slide by the locking tabs 36, 38, deflecting the locking tabs outward. When the rear end 20 of the wedge 14 passes the front latching surfaces 42 of the locking tabs 36, 38, the locking tabs 36, 38 snap back to their normal position. Thus, the latching surfaces 42 spring back to a blocking position behind the rear end 20 of the wedge 14 to prevent inadvertent withdrawal of the wedge through the rear end 20.

Figure 2B:
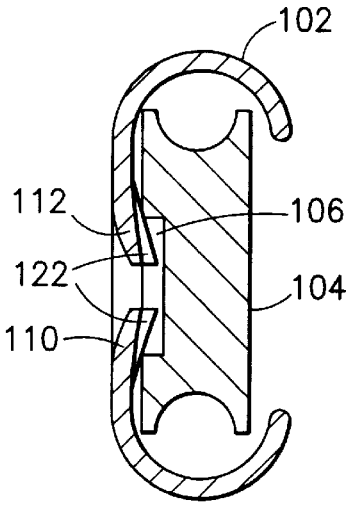
FIG. 2B is a cross-sectional view of the connector shown in FIG. 2A taken along line 2B—2B.
Figure 2A:
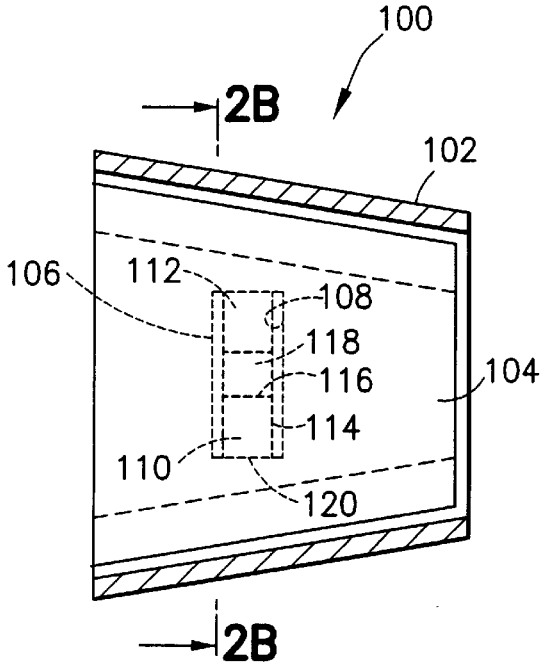
FIG. 2A is a partial cross-sectional view of an alternate embodiment of the wedge connector.

Referring now to FIGS. 2A–2B an alternate embodiment of the present invention is shown. In this embodiment the wedge connector 100 has a shell 102 and a wedge 104. The shell and wedge are about the same length. The wedge 104 has a pocket 106 in the middle of one laterial side with a front latching surface 108. The shell 102 is similar to the shell 12, but the locking tabs 110, 112 are located proximate the longitudinal middle of the shell. The locking tabs 110, 112 are similar to the tabs 36, 38 with each having a front facing latching surface 114, a lateral open edge 116 at a slot 118, an opposite outer lateral connecting section 120, and inward facing ramp surfaces 122.

Referring now to FIGS. 3A, 3B, 4A and 4B, a third embodiment of the electrical wedge connector is shown. In this embodiment the connector has a shell 202 and a wedge 204. The shell 202 has two triangular shaped locking tabs 206, 208 located proximate the front end 210 of the shell. A hole 211 separates the two tabs. Similar to the tabs 36,38, the tabs 206, 208 each comprise a sheared front facing latching surface 212, a lateral open edge 214, a connecting section 216 and an inward facing ramp surface 218. The wedge 204 has two conductor contact surfaces 220, 222; one for a small conductor and one for a larger conductor. The wedge 204 also has a front end 224 with a ramp 226 on one side and a pocket or groove 228. The front end of the pocket 228 has a latching surface 230 for latching with the latching surfaces 212 of the locking tabs 206, 208 to prevent unintentional withdrawal of the wedge from the shell.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. In an electrical wedge connector having a connector sleeve and a wedge insertable into the connector sleeve for wedging electrical conductors against an inside surface of the sleeve to mechanically and electrically connect the conductors to each other, wherein the improvement comprises:

the sleeve having a locking tab to lock the wedge in the sleeve, the locking tab extending in a cantilevered fashion into a wedge receiving area of the sleeve, the locking tab having a front facing latching surface, a lateral edge extending from the front facing latching surface, and a connecting section located on a side of the locking tab opposite the lateral edge connecting the locking tab to the sleeve, wherein the sleeve comprises two of the locking tabs, and wherein the locking tabs are generally mirror images of each other.

2. A wedge connector as in claim 1 wherein the front facing latching surface comprises a sheared edge formed by stamping the sleeve.

3. A wedge connector as in claim 1 wherein the sleeve is comprised of sheet metal.

4. A wedge connector as in claim 1 wherein the locking tab has a ramp surface between a rear end of the locking tab and the front facing latching surface.

5. A wedge connector as in claim 1 wherein the locking tab is located proximate a rear end of the sleeve.

6. A wedge connector as in claim 1 wherein the locking tab is located proximate a middle of the sleeve and the wedge has a pocket to receive the locking tab.

7. A wedge connector as in claim 1 wherein the locking tab is located proximate a front end of the sleeve.

8. A wedge connector as in claim 1 wherein the locking tabs are directly opposite each other with a hole therebetween.

9. In an electrical wedge connector having a connector sleeve and a wedge insertable into the connector sleeve for wedging electrical conductors against an inside surface of the sleeve to mechanically and electrically connect the conductors to each other, wherein the improvement comprises:

the sleeve having two locking tabs to lock the wedge in the sleeve, the locking tabs extending into a wedge receiving area of the sleeve generally towards each other and having general cantilevered shapes.

10. A wedge connector as in claim 9 wherein the locking tabs have front facing latching surfaces comprising of sheared edges formed by stamping the sleeve.

11. A wedge connector as in claim 9 wherein the sleeve is comprised of sheet metal.

12. A wedge connector as in claim 9 wherein the locking tabs each have a ramp surface between a rear end of the locking tab and a front facing latching surface of the locking tab.

13. A wedge connector as in claim 9 wherein the locking tabs are located proximate a rear end of the sleeve.

14. A wedge connector as in claim 9 wherein the locking tabs are located proximate a front end of the sleeve.

15. A wedge connector as in claim 9 wherein the locking tabs are generally mirror images of each other.

16. A wedge connector as in claim 15 wherein the locking tabs are directly opposite each other with a hole therebetween.

17. A method of manufacturing a wedge connector sleeve for a wedge connector comprising steps of:

forming a sheet metal member into a general wedge shape having a general cross-sectional C-shape; and stamping the sheet metal member to form two cantilevered flaps with front facing latching surfaces formed by sheared edges occurring during the step of stamping, lateral connection sections forming cantilever connection bases for the cantilevered flaps and extending directly from the front facing latching surfaces, and ramp surfaces leading up to the latching surfaces.

18. In an electrical wedge connector having a connector sleeve and a wedge insertable into the connector sleeve for wedging electrical conductors against an inside surface of the sleeve to mechanically and electrically connect the conductors to each other, wherein the improvement comprises:

the sleeve having two locking tabs to lock the wedge in the sleeve, the locking tabs extending into a wedge receiving area of the sleeve generally towards each other and having general cantilevered shapes, wherein the locking tabs are located proximate a middle of the sleeve and the wedge has a pocket to receive the locks tabs.

* * * * *